US008936204B2

(12) United States Patent
Heatley

(10) Patent No.: US 8,936,204 B2
(45) Date of Patent: Jan. 20, 2015

(54) INVERTED SPRAY PAINT SYSTEM USING COMPRESSED AIR

(75) Inventor: Christopher Heatley, McHenry, IL (US)

(73) Assignee: Seymour of Sycamore Inc., Sycamore, IL (US)

( * ) Notice: Subject to any disclaimer, the term of this patent is extended or adjusted under 35 U.S.C. 154(b) by 282 days.

(21) Appl. No.: 12/915,088

(22) Filed: Oct. 29, 2010

(65) Prior Publication Data

US 2011/0057052 A1 Mar. 10, 2011

Related U.S. Application Data

(63) Continuation-in-part of application No. 12/485,971, filed on Jun. 17, 2009, now abandoned.

(51) Int. Cl.

| | |
|---|---|
| ***B05B 9/00*** | (2006.01) |
| ***A63C 19/06*** | (2006.01) |
| ***B05B 9/08*** | (2006.01) |
| ***E01C 23/22*** | (2006.01) |

(52) U.S. Cl.

CPC ..... *A63C 19/065* (2013.01); *B05B 9/0822* (2013.01); *E01C 23/22* (2013.01); *A63C 2019/067* (2013.01)

USPC ..... 239/147; 239/337; 239/373

(58) Field of Classification Search

USPC ..... 239/146, 147, 150, 151, 172, 360, 157, 239/158, 337, 373; 11/146, 147, 150, 151, 11/172, 360

See application file for complete search history.

(56) References Cited

U.S. PATENT DOCUMENTS

| | | | | |
|---|---|---|---|---|
| 3,050,260 | A * | 8/1962 | Macrae et al. | 239/150 |
| 3,976,231 | A * | 8/1976 | Betulius | 222/616 |
| 4,064,679 | A * | 12/1977 | Spinner | 56/2 |
| 4,135,669 | A * | 1/1979 | Bridges et al. | 239/373 |
| 4,524,912 | A | 6/1985 | Jones | |
| 4,600,150 | A | 7/1986 | Zelasko | |
| 4,624,602 | A * | 11/1986 | Kieffer et al. | 239/150 |
| 5,302,207 | A | 4/1994 | Jurcisin | |
| 5,931,207 | A * | 8/1999 | Gianino | 141/382 |
| 6,295,757 | B1 * | 10/2001 | Fields, II | 47/1.5 |
| 2004/0164182 | A1 * | 8/2004 | Joseph et al. | 239/345 |

FOREIGN PATENT DOCUMENTS

| | | |
|---|---|---|
| AU | 8643582 | 10/1984 |
| GB | 1602870 | 11/1981 |
| WO | 97/33699 | 9/1997 |

OTHER PUBLICATIONS

International Search Report and Written Opinion for PCT/US2011/058566, completed Jan. 4, 2012.

International Search Report and Written Opinion for corresponding PCT patent application No. PCT/US2010/039023, Nov. 2. 2010.

* cited by examiner

*Primary Examiner* — Jason Boeckmann

(74) *Attorney, Agent, or Firm* — McDonnell Boehnen Hulbert & Berghoff LLP

(57) ABSTRACT

A spray paint system for spraying a horizontal surface having a frame supporting an inverted elongated rigid container configured to hold a paint formulation that is pressurized with a pumping device partially located within the container where the frame has at least one wheel to allow a user to roll the system along a horizontal surface while spraying paint through a removable spray tip. This system can be used to mark a horizontal surface with precise and clear writing of lines, letters or symbols.

5 Claims, 3 Drawing Sheets

INVERTED SPRAY PAINT SYSTEM USING COMPRESSED AIR

CROSS REFERENCE TO RELATED APPLICATIONS

This application is a continuation-in-part of U.S. patent application Ser. No. 12/485,971 filed Jun. 17, 2009, the entire contents of which are being incorporated herein by reference.

BACKGROUND

My invention relates to a spray paint system that does not require the use of traditional organic based propellants in the paint mixture. My system uses an inverted or substantially vertical container where a paint formulation in liquid form occupies the lower section of the container and compressed air occupies an upper portion of the container above the paint mixture. Pressurizing the air in the space above the paint forces the paint out through a replaceable nozzle or tip that is attached to the lower end of the container. The spray paint system has a variety of uses all involving an inverted position relative to standard spray painting applications, such as marking objects, specifically making precise pin point markings, such as letters or symbols, on horizontal objects, such as roadways, buildings, walkways, etc. to assist construction or utility repair crews and the like.

Many spray paint systems are known and generally fall into two categories. The ubiquitous aerosol can of spray paint is well known. In this system a paint mixture and a propellant, typically an easily vaporized hydrocarbon or other organic based compound, are injected into the can under pressure. The paint and propellant are discharged through a valve attached to the top of the can when held in an upright orientation. Such systems only contain organic compounds as the propellant, which are mixed with the paint formulation. Once the propellant is exhausted from the can no more paint can be removed, thus making for a wasteful situation. Additionally, these aerosol spray paint cans are costly to manufacture, present a disposal problem, and typically use high cost hydrocarbon propellants that can be harmful to the environment.

The second known spray paint system is where a paint formulation is added directly to a rigid container at ambient pressure (no propellant mixed with the paint formulation). The container is then pressure sealed and a source of pressurized fluid, typically compressed air, is regulated through an inlet into the container causing the paint formulation to pressurize above atmospheric pressure. The container is held in an upright position and a trigger mechanism is activated so that pressurized paint is then forced out of the rigid container through an attached hose and then through a special spray nozzle with combined valve means that is designed to atomize the entrained paint particles. Such systems only operate in an upright position. A variant of this system uses a venturi to entrain paint in a high-pressure air stream.

My invention eliminates the disadvantages of these known spray paint systems through the use of an inverted spray paint system that can be pressurized using only air.

These and other advantages will be apparent from the following detailed discussion of my invention and the appended claims.

SUMMARY

My invention is an improved spray paint system that does not require the use of a traditional hydrocarbon propellant and instead uses an inverted elongated cylindrical container pressurized with air using a pump that is partially contained within the container. Specifically, one embodiment of my invention comprises, in combination, an inverted spray paint system having a rigid elongated container having an interior space, a first opening located at an upper end of the container and a second opening located at a lower end of the container. A paint mixture can be located in the interior space at the lower end of the interior space of the container. The lower end is defined as the end closest to the ground. The upper end of the interior space (opposite the lower end) contains a portion of a pumping device that sits above the paint mixture. The pumping means is used to pressurize the space above atmospheric pressure in order to force the paint formulation out through the second opening. The system also has at least one cap configured to releasably attach the pumping device to the upper end of the container and to allow introduction of a liquid paint mixture into the container. The system has a removable spray tip in fluid communication with the second opening of the rigid container that allows for egress of the paint mixture in a spray pattern upon activation of a trigger operably connected to the rigid container.

In yet another embodiment of my invention, a spray paint system is provided comprising, in combination, a rigid elongated container having an interior space, a first opening located at an upper end of the container and a second opening located at a lower end of the container. A frame that supports the elongated container has a frame handle located near the upper end of the elongated container to assist a user of the system to move the container while spray painting a horizontal surface. This embodiment also has a pumping device partially contained in the upper end of the interior space of the elongated container and has a pump handle connected to the pumping device configured to allow a user to manually activate the pumping device to pressurize the interior space to a pressure greater than atmospheric pressure. The frame has at least one wheel mounted to it near the lower end of the container to allow a user to roll the spray paint system along a horizontal surface during paint application. A removable spray tip in fluid communication with the second opening of the elongated container is configured to allow a pressurized paint formulation within the interior space to exit the elongated container in a spray pattern directed onto a horizontal surface as a user moves the painting system using the wheel. There also is a trigger positioned near the upper end of the elongated container that is operably connected to the container and is used to activate delivery of a pressurized paint mixture through the spray tip.

My invention can also be configured where the trigger is operably connected to the spray tip and preferably where the trigger is connected to a cable that is operably connected to a valve in the spray tip. In order to keep the spray paint system in a generally vertical position when not rolling or moving the system it is preferred to include a vertical stabilizer near the lower end of the container attached to either the frame, the container or to both. The pumping device is preferably a self-contained assembly that can be removed from the container and that has a handle accessible to a using for manually activating the pump. The pump can be connected to the container through the first opening in the upper end of the container. The spray paint system can also include a pressure indicator in fluid communication with the container to show the user the pressure level in the container. Likewise, the system can include a pressure relief valve in fluid communication with the container as a safety feature to prevent over pressuring of the system.

Regardless of the mechanical configuration of my spray paint system, an important aspect of my invention is that the only propellant used is compressed air. The system does not contain any volatile compounds, such as hydrocarbons.

Although a preferred pumping device is self-contained within the system of my invention, for example a hand pump, it can also be a completely external pumping means. In either case the pumping device is in communication with the first opening to create the pressurized air above the paint mixture. The pressure source can comprise any known means to generate a fluid under pressure, for example a pump or cylinder of compressed gas. If a pump is used, then it can be battery operated, similar in design to battery operated power tools, or it can be powered using a conventional AC power source.

My spray paint system is to be used only in a generally downward direction with the paint formulation being dispensed through a spray tip or nozzle located at the lower end of the container. Control of the paint flow is accomplished by controlling pressure within the elongated container, by opening and closing a valve in fluid communication with the spray tip, or a combination of both. A trigger or valve or other regulation means that is in fluid communication with the source of pressurized fluid or with the pressurized paint mixture can accomplish this. Increasing or maintaining a given pressure within the elongated container will work to continuously force the paint out through the discharge opening and the spray tip. Decreasing or stopping the pressure in the container will slow or stop the rate of paint flow.

BRIEF DESCRIPTION OF THE FIGURES

The advantages and features of the present invention will become better understood with reference to the following more detailed description and claims taken in conjunction with the accompanying drawings, in which like elements are identified with like symbols, and in which:

DETAILED DESCRIPTION

Figure 1:
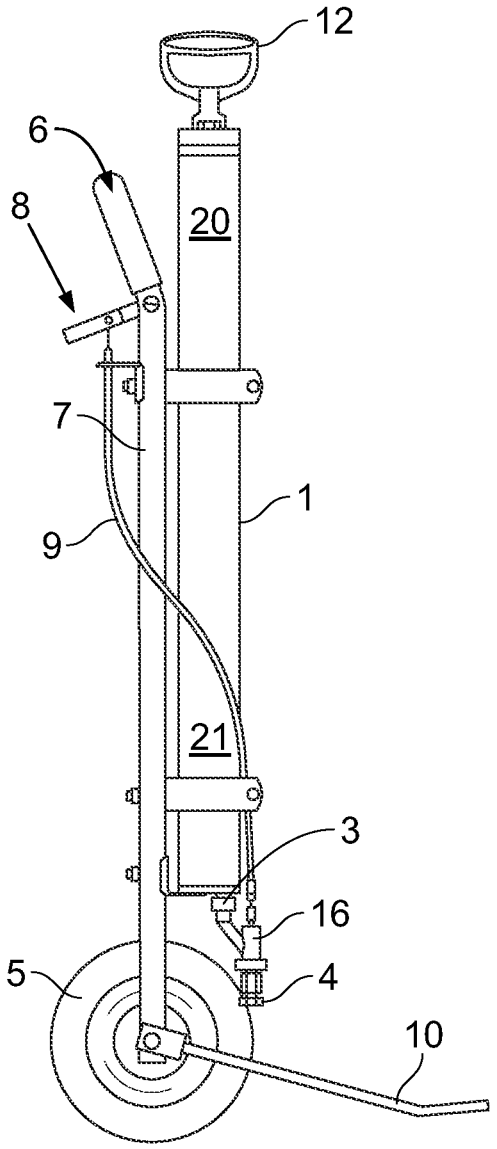
FIG. 1 is a schematic representation showing a side view of one embodiment of my invention.
Figure 2:
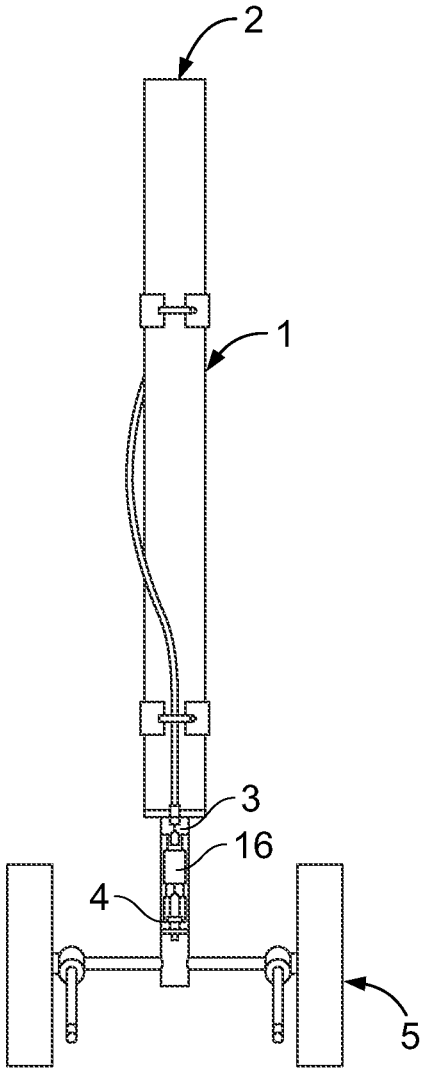
FIG. 2 is a schematic representation showing a front view of the embodiment illustrated in FIG. 1.
Figure 3:
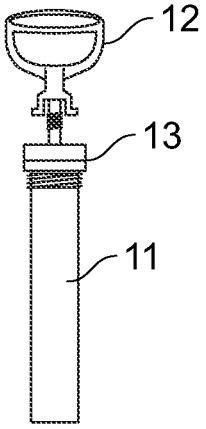
FIG. 3 is a schematic representation of one embodiment of a self-contained hand pump that can be inserted into the elongated cylinder of my invention.

Referring now to FIGS. 1-2, which shows just one of many possible configurations, sizes, and shapes of the elongated container 1 of my spray paint system, the container is preferably fabricated from any material of construction that can withstand pressures greater than atmospheric, preferably in the range of from about 20 psig to about 120 psig. Rigid plastics, glass, metal or like materials will all be acceptable. Container 1 has an interior space, a first opening 2 and a second opening 3. The upper end 20 of the interior space accepts or receives pumping device 11 (see FIG. 3), which includes a hand pump 12 that is used to manually operate the pump to pressurize the interior space above atmospheric pressure. As the pump handle is stroked by a user air is forced into the upper section of the interior space and subject to compressive forces, which continually increases the pressure in the upper end of the container.

Figure 4:
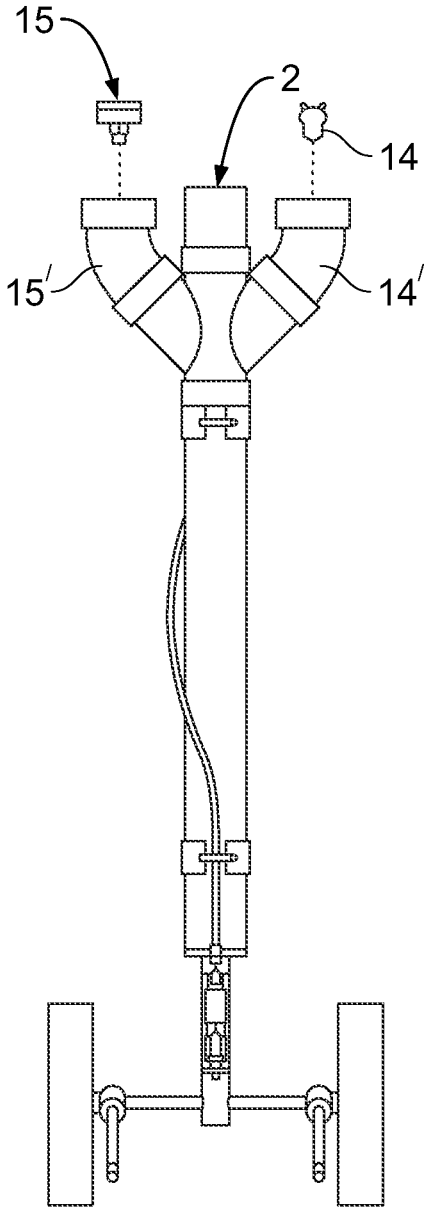
FIG. 4 is a schematic representation showing a front view of a second of one embodiment of my invention.

The container also has a lower end 21 that holds a liquid paint mixture added through opening 2. First opening 2 is configured to allow the pump device to be placed in the interior of rigid container 1 and then sealed within using cap 13. Cap 13 is removable to allow removal of the pump and access to the interior space of the container. Cap 13 can connect with container 1 through connection means, which can be any known type of connection that will maintain applied pressure to the interior of container 1, for example, screw threads, snap lock, bayonet fitting, snap lock released through threads, claps, and the like connections. Second opening 3 allows a pressurized fluid, such as compressed air, nitrogen, carbon dioxide, and the like, to be introduced to the interior of container 1. Optionally, container 1 may have a relief valve 14 (see FIG. 4) secure in opening 14' to vent excess pressurized fluid from the interior if an over-pressurization occurs. Additionally, the container may have a pressure gauge 15 secure in opening 15' to allow the user to monitor the pressure within the container.

When the air in the upper end of the interior of the rigid container is pressurized, which creates a force exerted on the paint mixture that will cause it to exit the lower end of the container through discharge or second opening 3. To control the discharge or spray pattern of the exiting paint, a spray tip or nozzle 4 is connected to discharge opening 3. Preferably tip 4 is removable and can also be disposable. One possible design includes a nozzle 4 that is capable of accepting a tip insert (not shown) to allow for very fine painting of numbers and letters. The insert can be releasably connected to the spray nozzle through any connection type known to the art provided that the insert can be disconnected and re-connected without damaging the insert or the spray nozzle 4. Preferred connections would include a screw fitting, snap-lock, press fit, luer-lock, bayonet, quick disconnect, or any other known releasable connector. For ease and speed of connection the most preferred connector is a press fit connection.

Although a specific type of pump is shown in the embodiment in the Figures the pump can also be configured as a battery or AC operated device or other pressure device, such as a small cylinder of compressed gas that can supply a pressurized fluid (air or other gas) through the first opening 2 or through another opening located in the upper end of the container. In some circumstances it may be convenient to design the pump to accept power in the form of DC current supplied by a cigarette lighter or other power connector now typically available in most automobiles, trucks or other vehicles. The spray paint system also comprises a frame 7 that holds or supports (both permanently or removably) container 1. The frame can be composed of any structural material, such as plastic or metal that will adequately support the container. Preferably the frame has a handle 6 that allows the user to move the system along a horizontal surface using one or more wheels 5 attached to either the frame or the container.

The frame could also have one or more vertical stabilizers 10 to maintain the system in a substantially upright position when not being moved along a horizontal surface. The system also preferably has a trigger or actuator 8 to cause the paint to be sprayed through nozzle 4. Preferably the trigger is located near the upper end of the container near the handle to allow convenient access to the user when pushing or pulling the system along a horizontal surface. Most preferably, the trigger is connected via cable 9 or other linkage to valve 16 in fluid communication with the interior space and the nozzle. Once the upper end of the interior space of the container has been pressurized with ambient air using the pumping device, the user will activate the trigger to open the valve to allow the paint to spray outward through the nozzle. The percentage opening of the valve dictates the flow rate of paint through the discharge opening of the container and spray tip.

Figure 5:
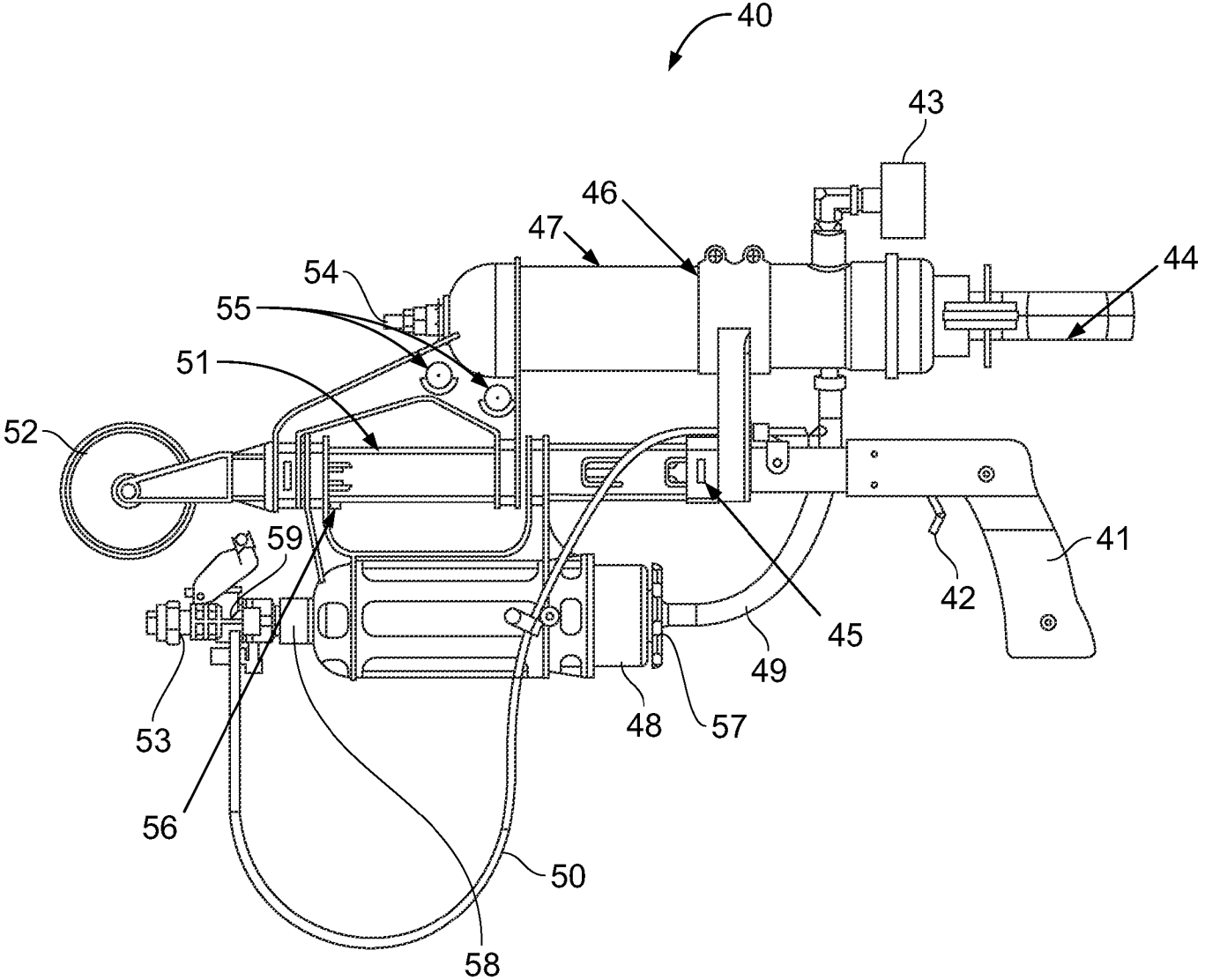
FIG. 5 is a schematic representation of another embodiment of my invention.

Yet another possible embodiment of my invention is illustrate in FIG. 5, where utility sprayer 40 comprises a pump assembly 47 mounted to a telescopic frame 51 through bracket 46. The pump assembly comprises a reservoir that can withstand pressures up to 60 psig or higher and can be pressurized with ambient air using a hand pump 44 or alternatively through fitting 54, such as a standard tire or inner tube fitting, using any compressed gas source, such as a compressed gas cylinder or air compressor. Pressure gauge 43 is used to monitor the pressure in pump 47. The telescoping frame 51 is released by pushing button or release mechanism 56. Once button 56 is pushed, frame 51 can be extended to increase the distance between wheel 52 and handle 41 to allow utility spray 40 to extend to a convenient operating length. In the fully extended configuration the sprayer 40 can be wheeled along a surface to be painted and in the fully collapsed configuration the sprayer can be held like a wand and easily pointed at the surface to be painted, without using wheel 52. Snap features 45 can be used to lock the telescoping frame 51 at various predetermined lengths.

Pressure hose 49 connects the pressure reservoir of pump assembly 47 with a paint bottle 48 through connector or cap 57. Paint bottle 48 also has a second connector 58 to accept nozzle 53 or spare nozzles 55. Preferably, connectors 57 and 58 are non-standard in that they are coded specifically for utility sprayer 40 such that only pressure hose 49 and nozzles 53 and 55 can be connected. Paint bottle 48 may hold any paint composition directly and may be constructed of materials such that it is biodegradable upon disposal. Alternatively, a collapsible pouch or bag of paint maybe inserted into the bottle that can easily be discarded when empty, thus eliminating clean up of the bottle. Preferably the pouch is biodegradable.

Trigger 42 is operably connected to cable 50 and operates a valve 59 associated, or in fluid connection, with nozzle 53. Squeezing trigger 42 opens valve 59 and allows pressurized paint from bottle 48 to flow out of nozzle 53. Nozzles 53 and 55 can be adjustable to vary the spray pattern from a wide to a tight angle depending on the application and surface to be painted. Preferably the frame, pump assembly and paint bottle/nozzle assembly are configured so that these three assemblies are modular or otherwise each easily removable from the utility sprayer such that one or more malfunctioning assembly can be replaced with a new or otherwise operating assembly.

It is important that the elongated container or paint bottle is positioned in an inverted and vertical position so the paint formulation can be sprayed onto horizontal objects, especially those located on or near ground level. My invention can be used to mark objects such as roadways, walkways, yards, buildings or other structures for construction, survey, safety, or the like purposes.

The invention has been described with reference to a preferred embodiment. Obviously, modifications and alterations will occur to others upon reading and understanding the preceding specification. It is intended that the invention be construed as including all such alterations and modifications insofar as they come within the scope of the appended claims or the equivalents thereof.

The invention claimed is:

1. An inverted spray paint system comprising, in combination, the following;

a) a rigid telescoping frame having a single handle at one end and separated by a longitudinal length from a single wheel at the opposite end of the frame in a first position defining a distance between the handle and the wheel, wherein the frame is configured to extend the longitudinal length when in a second position such that the distance between the handle and the wheel is increased in a longitudinal direction, where the frame has no other wheels connected thereto;

b) a paint bottle having a first and second connector, where the bottle is removably mounted to the frame and having a paint reservoir configured to withstand an internal pressure of 60 psig;

c) a pump assembly in fluid communication with the paint bottle through the first connector, wherein the pump assembly comprises a pressure reservoir configured to withstand an internal pressure of 60 psig and to directly supply compressed gas through the first connector to pressurize the paint bottle;

d) a pressure gauge attached to the reservoir and configured to monitor the internal pressure of the reservoir;

e) a pressure hose connecting the pressure reservoir and the paint bottle through the first connector and configured to transmit only compressed gas from the reservoir into the bottle;

f) a removable spray nozzle in fluid communication with and connected to the paint bottle through the second connector; and g) a trigger mounted on the frame and operably connected to a valve in fluid communication with the nozzle and the paint bottle wherein the handle is configured for grasping and holding by a user's hand and to allow the user to operate the trigger without removing the user's hand from the handle and wherein the rigid telescoping frame when in the first position allows a user to hold the spray paint system in a position above the ground where the single wheel is not touching any surface and to point the spray system at a surface to be painted.

2. The spray paint system of claim 1 wherein the pump assembly comprises a hand activated pump and a standard tire pressure fitting.

3. The spray paint system of claim 1 wherein the telescoping frame has a release button to unlock the frame to allow the frame to move from the first position to the second position.

4. The spray paint system of claim 1 where the trigger is connected to a cable that is operably connected to the valve.

5. The spray paint system of claim 1 wherein at least one of the first and second connectors is a coded non-standard connector configured to connect only to a like coded non-standard connector.

* * * * *